US012152321B2

(12) United States Patent
Romagna et al.

(10) Patent No.: US 12,152,321 B2
(45) Date of Patent: Nov. 26, 2024

(54) REED MONITORING ASSEMBLY, DRAWING-IN MACHINE INCORPORATING SUCH A REED MONITORING ASSEMBLY AND PROCESS FOR MONITORING A REED WITH SUCH A REED MONITORING ASSEMBLY

(71) Applicant: STAUBLI SARGANS AG, Sargans (CH)

(72) Inventors: Hanspeter Romagna, Sargans (CH); Markus Wolf, Schaan (LI)

(73) Assignee: STAUBLI SARGANS AG, Sargans (CH)

( * ) Notice: Subject to any disclaimer, the term of this patent is extended or adjusted under 35 U.S.C. 154(b) by 295 days.

(21) Appl. No.: 17/618,581

(22) PCT Filed: Jun. 19, 2020

(86) PCT No.: PCT/EP2020/067112

§ 371 (c)(1),
(2) Date: Dec. 13, 2021

(87) PCT Pub. No.: WO2020/254583

PCT Pub. Date: Dec. 24, 2020

(65) Prior Publication Data

US 2022/0259778 A1 Aug. 18, 2022

(30) Foreign Application Priority Data

Jun. 19, 2019 (EP) ..... 1918128

(51) Int. Cl.
*D03J 1/24* (2006.01)
*D03J 1/14* (2006.01)

(52) U.S. Cl.
CPC .. *D03J 1/24* (2013.01); *D03J 1/14* (2013.01)

(58) Field of Classification Search
CPC ..... D03J 1/24; D03J 1/14; D03J 1/00
See application file for complete search history.

(56) References Cited

U.S. PATENT DOCUMENTS 4,748,568 A * 5/1988 Tobler ..... D03J 1/14 700/130
5,251,673 A * 10/1993 Adachi ..... D03D 51/34 139/370.1

(Continued)

FOREIGN PATENT DOCUMENTS

CN 205529299 U 8/2016
EP 1292728 B1 12/2006

(Continued)

OTHER PUBLICATIONS

Machine translation of JPH05287646 (Year: 1993).*

(Continued)

*Primary Examiner* — Khoa D Huynh
*Assistant Examiner* — Uyen T Nguyen

(57) ABSTRACT

A reed monitoring assembly to monitor a weaving reed that have dents juxtaposed along longitudinal direction of the weaving reed. The dents define height direction of the reed and reed gap. The assembly includes an optical device with a first camera array, for taking images of a first portion of the weaving reed, and facing the first longitudinal side of the weaving reed, an illumination device to illuminate the first portion of the weaving reed, and a second camera array, for taking images of a second portion of the weaving reed, and facing the opposite longitudinal side of the weaving reed. The reed monitoring assembly also includes a controller, for controlling the optical device and for receiving image data from the device, and mounting means allowing a relative movement between the weaving reed and the optical device, along an axis parallel to the longitudinal direction of the weaving reed.

20 Claims, 6 Drawing Sheets

(56) References Cited

U.S. PATENT DOCUMENTS

| | | | | | |
|---|---|---|---|---|---|
| 5,279,334 | A * | 1/1994 | Takegawa | D03J 1/002 | 139/192 |
| 5,388,618 | A * | 2/1995 | Decock | D03J 1/00 | 139/1 R |
| 2016/0177481 | A1 * | 6/2016 | Wolf | H04N 23/66 | 700/140 |
| 2017/0261651 | A1 * | 9/2017 | Powell | G02B 30/56 | |
| 2020/0123686 | A1 * | 4/2020 | Schnabel | D03D 27/10 | |

FOREIGN PATENT DOCUMENTS

| | | | | | |
|---|---|---|---|---|---|
| JP | 02160958 | A | | 6/1990 | |
| JP | 5287646 | A | | 11/1993 | |
| JP | H05287646 | | * | 11/1993 | D03J 1/14 |
| JP | 2016528400 | A | | 9/2016 | |
| WO | 8600346 | A1 | | 1/1986 | |
| WO | WO198571 | | * | 12/2001 | D03J 1/14 |
| WO | 2020254583 | A1 | | 12/2020 | |

OTHER PUBLICATIONS

Machine translation of WO0198571 (Year: 2001).*
International Search Report for PCT/EP2020/067112, dated Oct. 2, 2020.
European Search Report for Europe Application No. 19181281, dated Dec. 12, 2019.

* cited by examiner

REED MONITORING ASSEMBLY, DRAWING-IN MACHINE INCORPORATING SUCH A REED MONITORING ASSEMBLY AND PROCESS FOR MONITORING A REED WITH SUCH A REED MONITORING ASSEMBLY

TECHNICAL FIELD OF THE INVENTION

This invention relates to a reed monitoring assembly for monitoring a weaving reed for a weaving loom. This invention also relates to a drawing-in machine including, amongst others, such a reed monitoring assembly. Finally, the invention relates to a process for monitoring a reed for a weaving loom with a reed monitoring assembly.

The technical field of the invention is the one of weaving reed monitoring and measurement.

BACKGROUND OF THE INVENTION

In the field of weaving, it is known to use a reed in order to guide warp yarns near the shedding zone of a loom and in order to beat up, by front edges of the reed dents, the weft yarn inserted between the warp yarns against the fabric woven on the weaving loom. During its lifetime, a reed can be damaged or worn, to the point that it presents irregularities, for instance in terms of reed gap thickness, dent thickness, dent angle, dent density or that it includes bent dents or loose dents. Moreover, a reed can be dirty after a certain period of time. Bad reed quality and reed dirtiness may cause faults on a fabric woven on a weaving loom.

Therefore, ranking of weaving reed condition is regularly done by specialists who check by eyes if a given reed is good for weaving or if it needs to be repaired, cleaned or replaced. Such a check is not done systematically, for each warp change, since it is time consuming and requires a highly qualified manpower. On the other hand, weaving reeds can be preventively cleaned and repaired during their lifetime, in order to avoid quality problems on the woven fabrics. Such cleaning/repair operations are implemented after visual inspection or after a given number of hours of use, which is not always the best period to proceed.

As explained in EP-B-1 292 728, a drawing-in machine can optically determine the position of a reed gap relative to a drawing-in channel. The drawing-in machine can adapt the longitudinal position of a reed in order to correctly draw-in a warp yarn, but it is not meant to provide any information with respect to the reed condition.

The same applies to the device known from WO-A-8600346.

Therefore, no automatic control of a reed is provided, that could help a weaver to quickly and reliably assess the condition of a weaving reed.

SUMMARY OF THE INVENTION

This invention aims at solving these problems with a new reed monitoring assembly which does not require a highly qualified manpower for automatically and accurately checking the condition of a weaving reed. This invention also aims at ensuring a good fit of a reed to each fabric to be woven with a loom equipped with such a reed.

To this aim, the invention relates to a reed monitoring assembly for monitoring a weaving reed, this weaving reed having a first longitudinal side, a second longitudinal side opposite to the first longitudinal side and a plurality of dents juxtaposed along a longitudinal direction of the weaving reed. The dents define a height direction of the weaving reed and, between each pair of two adjacent dents, a reed gap. The weaving reed defines a transverse direction perpendicular to the longitudinal direction and to the height direction. This reed monitoring assembly includes an optical device with at least a first camera array, for taking images of a first portion of the weaving reed, the first camera array facing the first longitudinal side of the weaving reed. The reed monitoring assembly also includes a controller, for controlling the optical device and for receiving image data from this optical device, and mounting means allowing a relative movement between the weaving reed and the optical device, along an axis parallel to the longitudinal direction of the weaving reed. According to the invention, the optical device includes:

- an illumination device for illuminating the first portion of the weaving reed and
- a second camera array for taking images of a second portion of the weaving reed, the second camera array facing the second opposite longitudinal side of the weaving reed.

Owing to the invention, the reed monitoring assembly may be used to automatically check both longitudinal sides of a weaving reed, which enables efficiently detecting potential irregularities, such as bent dents, loose dents and/or dirtiness of the reed prior to, or upon, drawing-in of new warp yarns into the reed. The illumination device increases the efficiency of the image capture by the camera arrays. It is also well adapted to monitor double reeds for which two rows of dents form the weaving reed. The flexibility and easiness of operation of the reed monitoring assembly of the invention allows checking the reed condition prior to, or upon, each drawing-in operation, without requiring the expertise of a highly qualified manpower, which reduces the overall cost of operation of a weaving loom. Since weaving reeds are easily and quickly checked with the assembly of the invention, they can be checked before each warp change on a loom, which allows keeping on this loom a reed with a good fit with the yarns of the fabric to be woven.

According to further aspects of the invention, which are optional, such a reed monitoring assembly might incorporate one or several of the following features:

- The first and second camera arrays face each other, with the weaving reed in-between, along the transverse direction, and the first and second camera arrays take images of identical dents and identical reed gaps of the weaving reed for a given relative position of the optical device with regard to the weaving reed along the axis of relative movement between the weaving reed and the optical device.
- Each of the first and second camera arrays is formed of several optical sensors adjacent to one another and the respective fields of view of two adjacent optical sensors overlap in the reed height direction, the first and/or the second camera array preferably covering at least the full height of the dents.
- At least one of the first and second camera arrays includes non-telecentric optics.
- At least one of the first and second camera arrays comprises an auto-focus lens controlled by the controller.
- The mounting means include a reed drive generating the relative movement between the weaving reed and the optical device, along the longitudinal direction of the weaving reed, and the controller controls the reed drive.
- The reed monitoring assembly includes a nozzle for, in an operative state, blowing air on the some of the dents, at a location aligned, along the longitudinal direction of the weaving reed, with the field of view of at least one of the first and second camera arrays.

The reed monitoring assembly includes an airflow measuring device including at least a nozzle for blowing air and one sensor for sensing an airflow, this sensor being connected to the controller.

The reed monitoring assembly includes a movement measuring sensor for sensing a relative position, a relative speed and/or a relative acceleration between the weaving reed and the optical device along the axis of relative movement between the weaving reed and the optical device, the movement measuring sensor being connected to the controller.

According to a second aspect, the invention relates to a drawing-in machine including at least a drawing-in unit for inserting, along a drawing-in channel, a warp yarn within a reed gap defined between two adjacent dents of a weaving reed dent. The drawing-in machine also includes a main controller. According to the invention, this drawing-in machine includes a reed monitoring assembly as mentioned here-above, whereas the optical device of the reed monitoring assembly is fixed on a casing of the drawing-in unit. Preferably, the main controller of the drawing-in machine receives some image data from the optical device or some processed data from the controller of the reed monitoring assembly.

Advantageously, the drawing-in unit includes a blade movable along the drawing-in channel, between a retracted position out of a reed gap and an inserted position, inserted between two adjacent dents of a reed, whereas the two camera arrays are inclined with respect to the axis of relative movement between the weaving reed and the optical device and with respect to an axis parallel to the height direction of the weaving reed and whereas, when it is in its inserted position, the blade extends at least partially within the field of view of at least one of the first and second camera arrays.

According to a third aspect, the invention also relates to a process for monitoring a weaving reed with a reed monitoring assembly, such a weaving reed having a first longitudinal side, a second longitudinal side opposite to the first longitudinal side and a plurality of dents juxtaposed along a longitudinal direction of the weaving reed. The dents define a height direction of the weaving reed and, between each pair of two adjacent dents, a reed gap. The weaving reed defines also a transverse direction perpendicular to the longitudinal direction and to the height direction. According to the invention, the monitoring assembly comprises an optical device and a controller and this process includes at least the following steps:

a) taking at least a first image of at least partially two dents and one reed gap in-between, on the first longitudinal side of the weaving reed, with the optical device of the reed monitoring assembly;

b) taking at least a second image of at least partially two dents and one reed gap in-between, on the second longitudinal side of the weaving reed, with the optical device of the reed monitoring assembly;

c) sending to the controller of the reed monitoring assembly, image data corresponding to the first image;

d) sending to the controller of the reed monitoring assembly, image data corresponding to the second image;

e) moving the weaving reed with respect to the optical device, along an axis parallel to the longitudinal direction of the weaving reed.

The order of the steps, from step a) to step e), is not imperative.

In addition, such a process might incorporate one or several of the following optional features, taken in any technically admissible configuration During step e), the movement of the weaving reed along the axis parallel to the longitudinal direction of the weaving reed, with respect to the optical device, is continuous.

The process includes a further step of f) taking an image of a reed identification mark fixed on the weaving reed with the optical device of the reed monitoring assembly.

During steps a) and b), an illumination device is used as a front light for the first image and as a back light for the second image.

The reed monitoring assembly includes an air blowing nozzle as mentioned here-above, whereas, during step a) and/or step b), the first camera array, respectively the second camera array, takes at least an image when the nozzle is in operative state and at least another image when the nozzle is not in operative state and in that the controller compares these two images.

The reed monitoring assembly is associated to a blade which is movable between a retracted position out of a reed gap of the weaving reed and an inserted position, inserted between two adjacent dents of the weaving reed, and during step a) and/or step b), the first camera array (82), respectively the second camera array (84), takes at least an image when the blade (6) is in the inserted position.

The process according includes a step of providing information about at least one of the following parameters: reed dent thickness or reed gap thickness along the axis parallel to the longitudinal direction of the weaving reed, presence of broken dents or of loosen dents, presence of damages on the reed components and dirtiness of the reed components.

The process includes a step of providing relative reed data, depending on the image data of step c) or d) and on reference data, the reference data being associated to the weaving reed being pictured during steps a) and b) of the current reed monitoring process and stored in a memory of the controller of the reed monitoring assembly prior to the current reed monitoring process.

BRIEF DESCRIPTION OF THE DRAWINGS

The invention will be better understood and other advantages thereof will appear more clearly upon reading of the following description of three embodiments of a reed monitoring assembly, and corresponding drawing in-machines and processes, provided solely as an example and made in reference to the appended drawings in which.

DESCRIPTION OF SOME EMBODIMENTS

Figure 1:
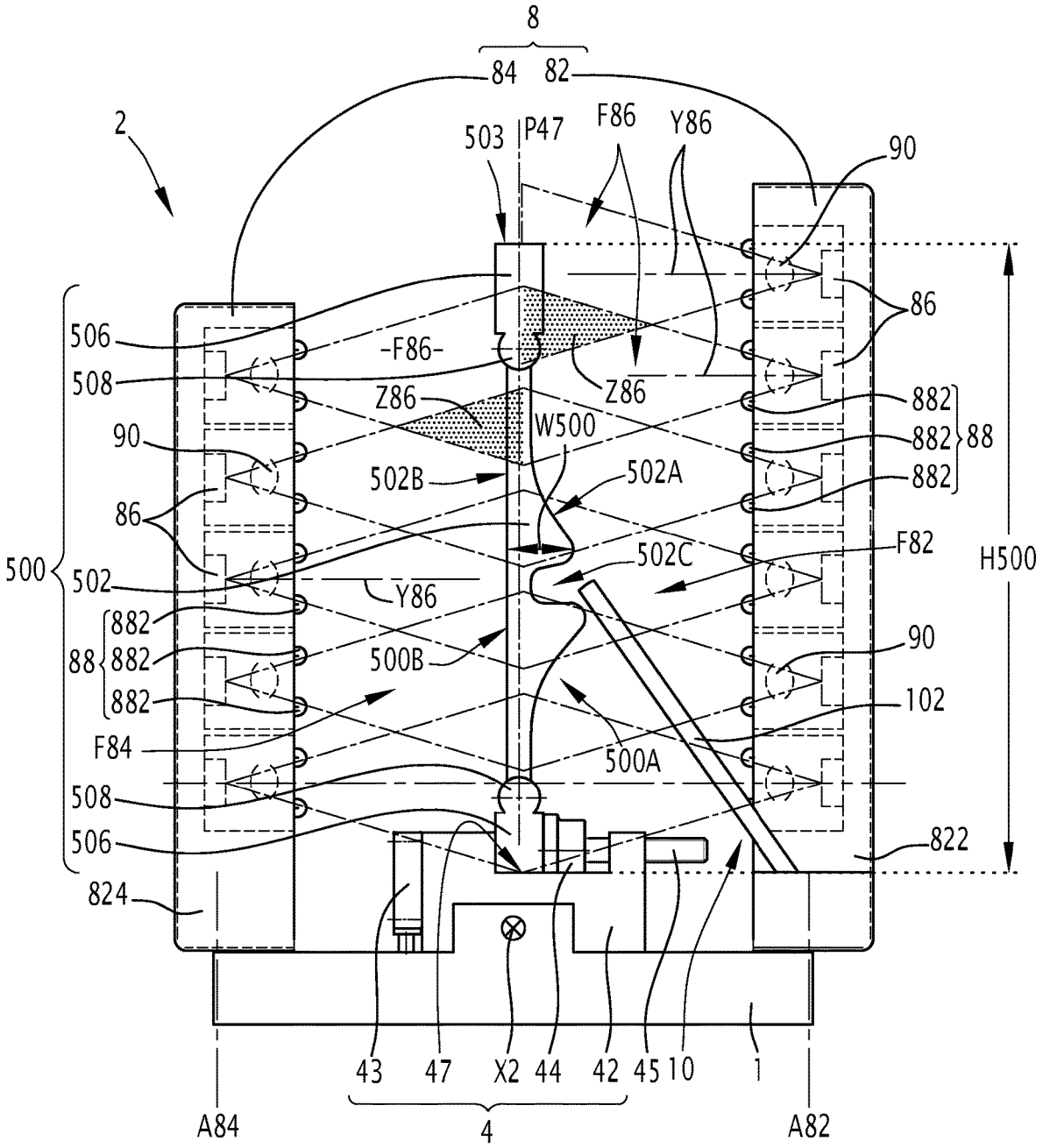
FIG. 1 is a schematic front view of a reed monitoring assembly according to the invention, incorporated into a drawing-in machine.
Figure 2:
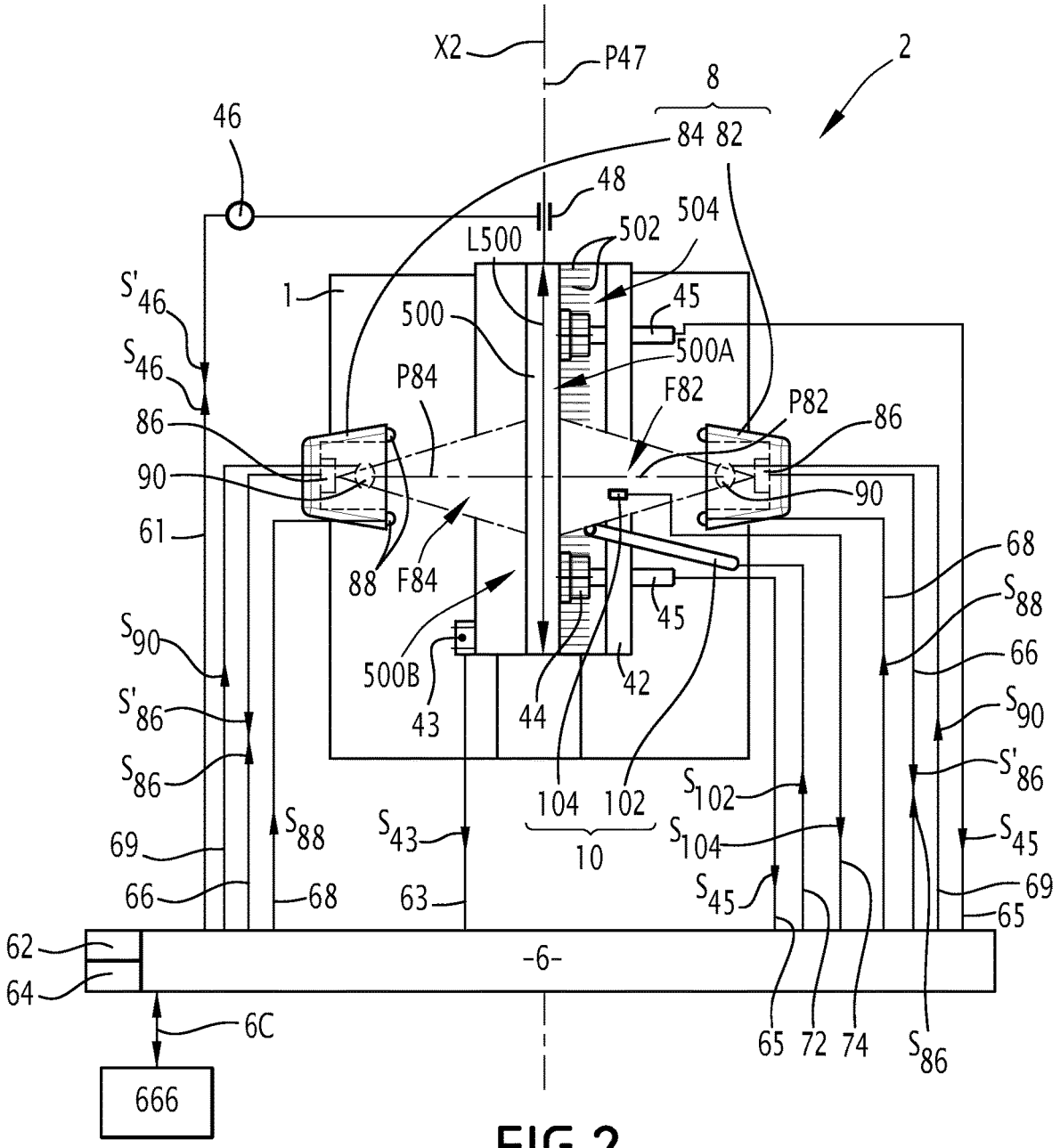
FIG. 2 is a top view of the reed monitoring assembly of FIG. 1, at a smaller scale.

The reed monitoring assembly 2 represented on FIGS. 1 and 2 is incorporated into a drawing-in machine. In a known manner, a drawing-in machine comprises a yarn clamping frame for clamping a yarn layer and a drawing-in unit casing. This drawing-in unit casing supports a heddle and/or a drop wire separation device, a yarn separation device, a drawing-in device with a hook moving along a drawing-in channel and a blade used for spreading two adjacent dents. The drawing-in machine also includes a harness receiving device and a main controller. As this is known per se, this is not represented on FIGS. 1 and 2, but for the casing 1 of the drawing-in unit and for the main controller 666 of the drawing-in machine.

When incorporating the invention, a drawing-in machine also comprises the reed monitoring assembly 2, which is fixed on the drawing-in unit casing 1 of the drawing in-machine. As it is fixed on casing 1, reed monitoring assembly 2 has the same movement, with respect to a weaving reed 500 received in the drawing-in machine, as the drawing-in unit casing 1. In some drawing-in machines, the drawing-in unit casing moves in translation with respect to the static yarn clamping frame, along its length. In some other drawing-in machines, the drawing-in unit is static and the clamping frame is moved with the reed with regard to the static drawing-in unit casing. In some other drawing-in machines, there is no yarn clamping frame and the drawn yarn is a portion of a yarn bobbin. The reed monitoring assembly 2 of the invention can be used with all these types of drawing-in machines.

In the present description, a longitudinal direction of the reed 500 is defined as the longer dimension of the reed, that is the reed length L500, along which a plurality of dents 502 are juxtaposed. Each pair of two dents, adjacent along the reed length L500, defines a reed gap 504 between them. In a known manner, a reed 500 includes two reed profiles 506, preferably made of aluminum, for anchoring the dents and two coils 508 for regularly spreading the dents 502 along the length L500 of the reed. Dents 502, reed profiles 506 and coils 508 are reed components. The reed height H500 is defined as the dimension of the reed parallel to the longer dimension of the reed dents 502 and perpendicular to longitudinal direction of the weaving reed 500. The reed width W500 is the transverse dimension of the reed perpendicular to reed length L500 and reed height H500. The two profiles 506 surround the two ends of the dents 502 in the height direction H500 and in the width direction W500. Each dent 502 has two edges extending out of the profiles 506, one edge being configured to come into contact with the weft yarn for beating the weft yarn against the fabric during the weaving process. The two edges, namely a front edge 502A and a back edge 502B, respectively belong to a first longitudinal side 500A and a second longitudinal side 500B of the weaving reed 500. These two longitudinal sides are opposite along a transverse direction, this transverse direction being perpendicular to the height direction H500 and to the longitudinal direction L500 of the reed, that is equal to the width or transverse dimension W500. In particular, the drawing-in channel extends parallel to the transverse direction or width W500. The first and second longitudinal sides of the reed, namely its first front side 500A and its second back side 500B, are oriented respectively to the right and to left on FIGS. 1 and 2.

According to the way casing 1 is oriented, height H500 can be horizontal or vertical in the drawing-in machine.

Reed monitoring assembly 2 comprises a reed transport device 4, which can be the same as the one used on the drawing-in machine during the drawing-in process. However, this is not compulsory.

Reed transport device 4 includes a reed carrier 42 and two reed clamps 44 for holding weaving reed 500 on reed carrier 42. Reed transport device 4 also includes an electric motor 46 associated to a rack-and-pinion mechanism 48 which together form a reed drive for driving reed carrier 42 in translation along a longitudinal axis X2 of reed monitoring assembly 2, which is parallel to the longitudinal direction L500 of reed 500. Reed carrier 42 and reed clamps 44 define a reed housing 47 extending along axis X2 for partially housing the weaving reed 500 when it is clamped in the reed carrier 42.

Reed monitoring assembly 2 also includes a controller 6, which can be the same as the main controller 666 of the drawing-in machine, or a part of it, or different from this main controller 666. This last possibility is represented on FIG. 2, with a communication line 6C between controllers 6 and 666.

Controller 6 is connected to electric motor 46 via a first electric line 61 conveying control signals $S_{46}$ from controller 6 to electric motor 46 and feed-back signals $S'_{46}$ from electric motor 46 to controller 6.

An optical device 8 belongs to reed monitoring assembly 2 and includes a first camera array 82 and a second camera array 84. Optical device 8 is fixed on casing 1, so that reed transport device 4 provides a relative movement between any weaving reed 500, mounted on reed carrier 42, and the optical device 8, mounted on casing 1.

The first camera array 82 is turned in a first transverse direction, parallel to the transverse direction W500 of the weaving reed 500 and the second camera array 84 is turned in a second transverse direction opposite to the first transverse direction. In other words, the first camera array 82 faces the first side 500A of the weaving reed and the second camera array 84 faces the second opposite side 500B of the weaving reed. The first camera array 82 and the second camera array 84 are respectively turned toward a median plane P47 extending from the reed housing 47 and perpendicular to transverse direction W500. The reed housing 47 is placed between the first camera array 82 and the second camera array 84 along the transverse direction W500.

Reed transport device 4 includes a movement measuring sensor 43 providing information about the relative position, speed and/or acceleration along the longitudinal axis X2 between optical device 8 and a weaving reed 500 mounted on reed carrier 42. This movement measuring sensor 43 is connected to controller 6 via a second electric line 63 conveying the output signal $S_{43}$ of this sensor 43.

In the example of FIGS. 1 and 2, movement measuring sensor 43 is an inductive sensor supported by the reed carrier 42. According to variants, movement measuring sensor 43 can be a laser velocimeter used for non-contact speed measurement or a linear transducer optically detecting a tape scale carried by the reed carrier 42. Movement measuring sensor 43 can be supported by the reed carrier 42, as shown on the figures, or by the optical device 8.

Reed carrier 42 supports two clamping sensors 45 used for providing an information about the actual clamping of the reed 500 on the reed carrier 42 via the reed clamps 44. Such clamping sensors 45 allow detecting if the reed has been disassembled from the reed carrier, in particular by releasing one of the clamps 44. A third electric line 65 connects each clamping sensor 45 to controller 6 and conveys an output signal $S_{45}$ of this clamping sensor.

The number of clamps 44 and of clamping sensors 45 may be different from two, depending in the length L500 of weaving reed 500. The number of clamps 44 may be different from the number of clamping sensors 45.

According to a non-represented aspect of the invention, the reed carrier 42 also includes several other sensors, namely reed position sensors, distributed along the reed carrier, parallel to reed length L500. These reed position sensors are used for detecting the actual position of the reed 500 within the reed carrier 42, along directions parallel to dimensions L500 and H500. These reed position sensors allow confirming that the reed 500 is correctly positioned on reed carrier 42, prior to using reed monitoring assembly 2.

As a summary, reed transport device 4 allows mounting reed 500 in reed housing 47, with respect to casing 1, and moving it parallel to its longitudinal direction L500 with respect to optical device 8. Reed transport device 4 also provides to the controller 6 some information with respect to how the reed 500 is positioned with respect to this optical device 8, in particular which dents or which series of dents is located between the two camera arrays 82 and 84, thanks to signal $S_{43}$.

According to another aspect of the invention which is not represented on the figures, reed carrier 42 is movable, with respect to the drawing-in unit casing 1, in the height direction, that is in a direction parallel to height H500 of reed 500. This allows adjusting the position of the reed 500 with regard to the drawing-in channel in the height direction of the dents 502. This height adjustment movement can be driven by a dedicated motor, preferably an electric motor, controlled by controller 6.

Each camera array 82 or 84 is made of several optical sensors 86 or camera modules which can be of the CMOS type (complementary metal oxide semi-conductor) or of the CCD type (charge coupled device) or any suitable other type of optical sensor. Each optical sensor 86 is a matrix of picture elements, adjacent to one another in the height direction H500 and in the longitudinal direction L500 of the reed 500, and built as one united sub-assembly. Optical sensors 86 are located next to one another in the height direction, that is in a direction parallel to height H500 of a reed 500 mounted on reed carrier 42. Optical sensors 86 can be color sensors or black and white sensors.

Photosensitive areas of the optical sensors 86 of each camera array 82 or 84 are turned toward the weaving reed 500 along the transverse direction W500. The photosensitive areas of the optical sensors 86 of the camera array 82 face the first longitudinal side 500A of the weaving reed 500 and the photosensitive areas of the optical sensors 86 of the camera array 84 face the second longitudinal side 500B of the weaving reed 500.

The use of adjacent optical sensors 86 within a camera array allows a compact design of the reed monitoring assembly, with a short focus distance and a scalable design, which is adaptable to the portion of the weaving reed to monitor.

F86 denotes the field of view of an optical sensor 86. As visible on FIG. 1 with shaded zone Z86, the fields of view of two adjacent sensors 86 overlap in the height direction H500.

F82 denotes the combination of the fields of view F86 of all optical sensors 86 belonging to first camera array 82. Similarly, F84 denotes the combination of the fields of view F86 of all sensors 86 belonging to second camera array 84. Combined fields of view F82 and F84 cover respectively a first portion and a second portion of the weaving reed 500, respectively on the front side 500A and on the back side 500B of this reed, on the full dent height. In fact, each first or second camera array 82, 84 covers, by its combined field of view F82 or F84, the full height of the dents 502, the coils 508 and at least a part of each profile 506 of the first portion, respectively second portion, of the weaving reed 500. Moreover, combined field of view F82 extends at least to the top surface 503 of the reed 500. As the fields of view of two adjacent sensors 86 overlap, discontinuities of each combined field of view F82 or F84 are avoided and some areas are detected twice which allows a better reed monitoring performance.

In practice, camera arrays 82 and 84 can be set so that the combined fields of view F82 and F84 cover at least 150 mm in height, that is in a direction parallel to height H500, and up to 100 mm in width, that is in a direction parallel to length L500. In practice, the width of fields of view F86 and combined fields of view F82 and F84, which is the same, is chosen to cover at least two dents 502 and one reed gap 504 in between, preferably three dents 502 and two reed gaps 504. Thus, its width can be much smaller than 100 mm.

The two camera arrays 82 and 84 are fixed relative to one another, in particular because they are fixed on casing 1. Along axis X2, they are located at the same longitudinal level, so that they face each other along the transverse direction W500, with the reed 500 in-between. In particular, the first and second portions of the reed 500 being in the respective combined fields of view F82 and F84 comprise identical dents 502 and identical reed gaps 504 of reed 500 mounted on reed carrier 42. In other words, these identical dents 502 and identical reed gaps 504 of reed 500 are at least partially in the combined field of view F82 and in the combined field of view F84 for a given relative position of the optical device 8 with regard to the weaving reed 500 along the axis X2. In other words, the first and second camera arrays 82, 84 take images of identical dents 502 and identical reed gaps 504 of the weaving reed 500 for a given relative position of the optical device 8 with regard to the weaving reed 500 along the axis X2. It allows an all-around view of each dent 502 and each reed gap 504.

A82 denotes the longitudinal axis of the first camera array 82 and A84 denotes the longitudinal axis of the second camera array 84, the longitudinal direction of a camera array being defined as its longer dimension. In this embodiment, axes A82 and A84 are parallel to the height H500 and perpendicular to axis X2 and to width W500. With the configuration of the weaving reed 500 shown on FIGS. 1 and 2, axes A82 and A84 are vertical, like height H500.

Y86 notes the sighting axis of an optical sensor 86, which is in the center of its field of view F86. The sighting axes Y86 of all optical sensors 86 of the first camera array 82 are coplanar and located in a plane P82, which is vertical and which is a central plane of combined field of view F82 in the longitudinal direction of the first camera array 82. Similarly, sighting axes Y86 of optical sensors 86 of the second camera array 84 are coplanar within a plane P84, which is vertical and is a central plane for combined field of view F84. Central planes P82 and P84 are aligned along axis X2, that is superimposed. The two camera arrays 82 and 84 covers the same dents 502 and the same reed gaps 504, on both longitudinal sides of the weaving reed 500. Thus, if sensors 86 of the two camera arrays 82 and 84 take a picture at the same time, they take pictures of same dents 502 and same reed gaps 504.

Camera resolution is compatible with reed dent thickness and reed gap thickness taken along the axis X2. In practice, the resolution of sensors 86 is chosen higher than 0.01 mm. The different sensors 86 belonging to one camera array 82 or 84 may be of a different resolution. For instance, sensors facing the dents 502 have a higher resolution than sensors 86 that face the profiles 506.

Camera arrays 82 and 84, in particular their sensors 86, are controlled by controller 6. As shown on FIG. 2, an electric line 66 conveys a control signal $S_{86}$ from controller 6 to each sensor 86 and the output signal $S'_{86}$ of each sensor 86 to controller 6.

Each camera array 82 and 84 is provided with an illumination device 88 formed by a ramp of LEDs 882 (light emitting diodes) distributed on the respective frames 822 and 824 of these two camera arrays 82 and 84. The illumination ramp 88 of the first camera array 82 faces and illuminates the first portion of the reed 500 and the illumination ramp 88 of the second camera array 84 faces and illuminates the second portion of the reed 500. Each illumination ramp 88 provides front light for the camera array on which it is mounted, that is the camera array on the same longitudinal side 500A or 500B of the weaving reed 500 as the illumination ramp 88. As the camera arrays 82 and 84 face each other along the transverse direction W500, each illumination ramp 88 also provides back light for the camera array located on the other longitudinal side of the weaving reed 500.

Front light illuminates the dents 502, the profiles 506 and the coils 508 which would, otherwise, be viewed in ambient light. Thus, front light improves the optical sensing by sensors 86 in poor lighting conditions.

Back light illuminates the reed from the opposite side, with respect to the sensors 86. In other words, the LEDs 882 and the sensors 86 face each other, with the reed 500 in-between. This creates a glowing effect on the edges of the reed components, in particular on the edges 502A or 502B of the dents that face the sensors 86, while the other areas of the reed are dark.

The light emitted by the LEDs 882 can be in the visible spectrum, with RGB components (red-green-blue) and in the non-visible spectrum, for instance in the infrared spectrum.

Controller 6 controls illumination ramps 88. As shown on FIG. 2, an electric line 68 conveys a control signal $S_{88}$ from controller 6 to each ramp 88. This signal 88 can be global for one illumination ramp 88 or differentiated for the respective LEDs 882 of this illumination ramp.

Each optical sensor 86 is associated with an optical unit 90 which includes optics and, advantageously, an autofocus lens. The optics of an optical unit 90 can be telecentric or non-telecentric. Telecentric optics are well suited for measuring dimensions, whereas non-telecentric optics are well suited to measure dirtiness, to detect damages on surfaces and to obtain an image from within a reed gap. Advantageously, telecentric and non-telecentric optics can be combined in the same camera array 82 or 84. In other words, some sensors 86 can be equipped with optical units 90 including non-telecentric optics, whereas some other sensors or the same camera array can be equipped with optical units including telecentric optics. Preferably, the non-telecentric optics are used for monitoring the top portion of the reed 500, where dirtiness mostly appears. The focus length of an autofocus lens, which also belongs to an optical unit 90, can be automatically controlled by varying a voltage applied to this autofocus lens. In such a case, as shown on FIG. 2, an electric line 69 conveys a control signal $S_{90}$ from controller 6 to each optical unit 90. This signal is representative of the focus length of the corresponding autofocus lens. The focus length of the corresponding autofocus lens can be adjusted picture by picture or only once for the whole reed monitoring process to be implemented with the reed monitoring assembly 2.

In a variant, the lens of at least one optical unit 90 can have a fixed non-variable focus length.

When equipped with adjustable focus length, the reed monitoring assembly 2 is adapted to monitor different weaving reed types and dimensions.

Controller 6 includes several components, such as a microprocessor 62 and a memory 64, and logical means, such as a computer program, in order to process the raw image data coming from the optical sensors 86 of each camera array 82 or 84 and other signals coming from the other parts of reed monitoring assembly 2.

In case controllers 6 and 666 are made by a single electronic unit, controller 666 works as explained hereabove for controller 6 and receives raw image data from sensors 86 of the first and second camera arrays 82 and 84, in the form of signals $S_{86}$. In case the controller 6 is different or separated from the main controller 666 of the drawing-in machine, that is in case the reed monitoring assembly 2 has a specific controller 6 in communication with the main controller 666 of the drawing-in machine, the controller 6 of the reed monitoring assembly 2 is designed for pre-processing the raw image data coming from the optical sensors 86 and forwarding it to the main controller 666 of the drawing-in machine, via the electric connection line 6C.

An airflow measurement device 10 also belongs to reed monitoring assembly 2 and includes one or several nozzles 102, only one of these nozzles being represented on FIGS. 1 and 2 for the sake of simplification. Each nozzle 102 is fastened with optical sensor 8 along axis X2. In other words, the relative movement between weaving reed 500 and a nozzle 102 is the same as the relative movement between this reed 500 and optical device 8. In addition to nozzle(s) 102, airflow measurement device 10 includes at least one airflow sensor 104 for measuring the airflow resulting from the air blown by the nozzle 102 in or close to a region where the output of this nozzle 102 is directed. The airflow measurement does not necessarily occur in the first or second portion of the reed covered by the field of view F82, respectively by the field of view F84, even if the result of this measurement can be combined with the reed data obtained via camera arrays 82 and 84. The nozzle(s) 102 blow air in direction of the reed dents 502 that are in the combined field of view F82 and/or F84. Actually, nozzle or nozzles 102 is or are adjustable in position relative to reed monitoring assembly 2, in particular with respect to optical device 8, for pointing a reed tunnel 502C formed by reed dents 502 on the front side of the weaving reed 500. Thus, the airflow measurement device 10 is specifically adapted to air jet weaving reeds with a reed tunnel 502C.

Each nozzle 102 is controlled by controller 6 with a signal $S_{102}$ conveyed by an electric line 72 for blowing an airflow in an operative state and for stopping blowing air in a non-operative state. The output signal $S_{104}$ of airflow sensor 104 is conveyed to controller 6 via an electric line 74. This output signal $S_{104}$ is used by controller 6 for quantifying the quality of the air jet within reed tunnel 502C, this quality being representative of the reed geometry in this zone.

According to a non-represented advantageous aspect of the invention, reed monitoring assembly 2 includes a marking device, for instance an ink-jet printer with different colors, for printing a mark on the reed during the reed monitoring process or once this reed has been controlled with the reed monitoring assembly 2. This marking device is controlled by controller 6, by proper electric signals.

Figure 3:
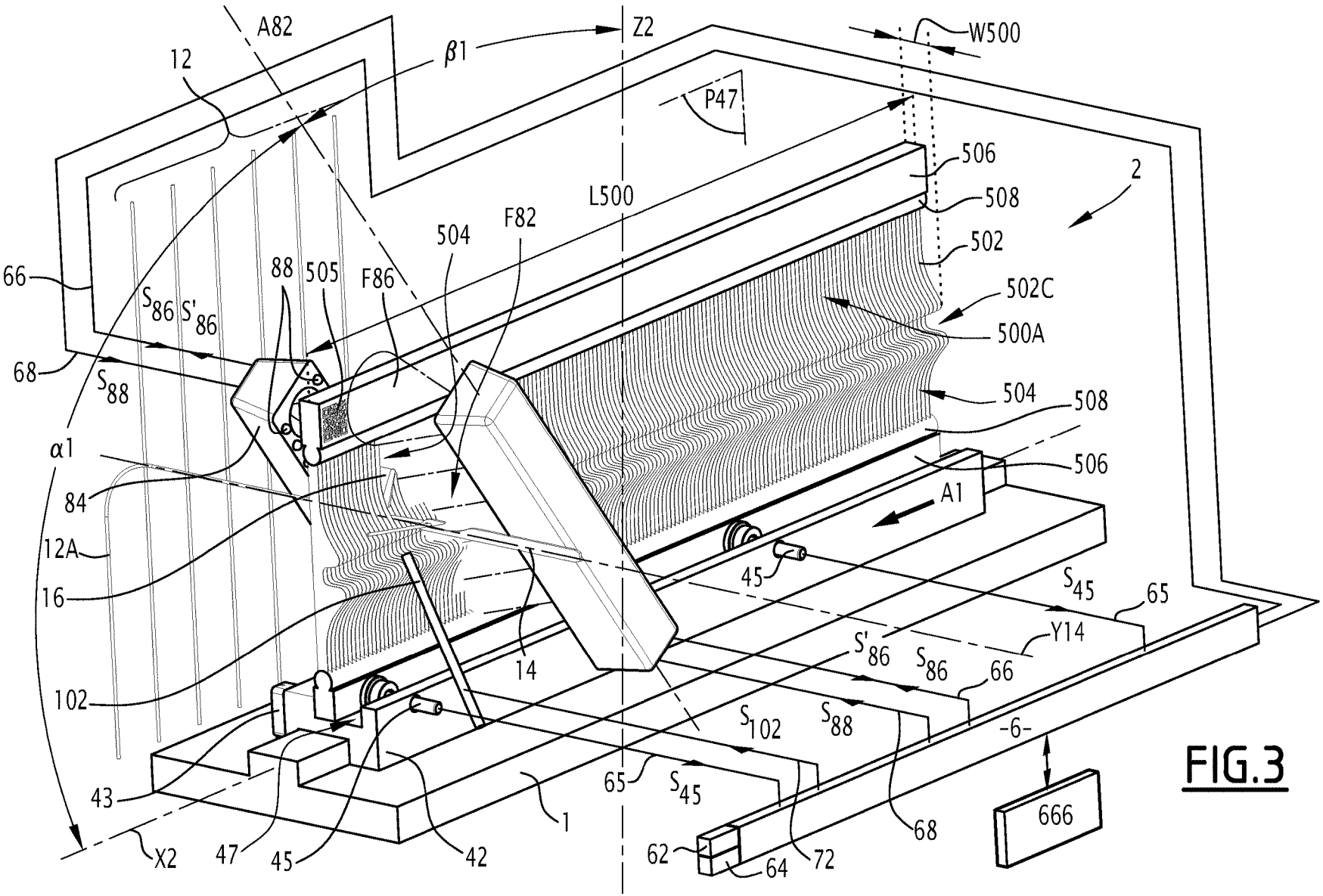
FIG. 3 is a perspective view of a reed monitoring assembly according to a second embodiment of the invention, incorporated into another drawing-in machine.
Figure 4:
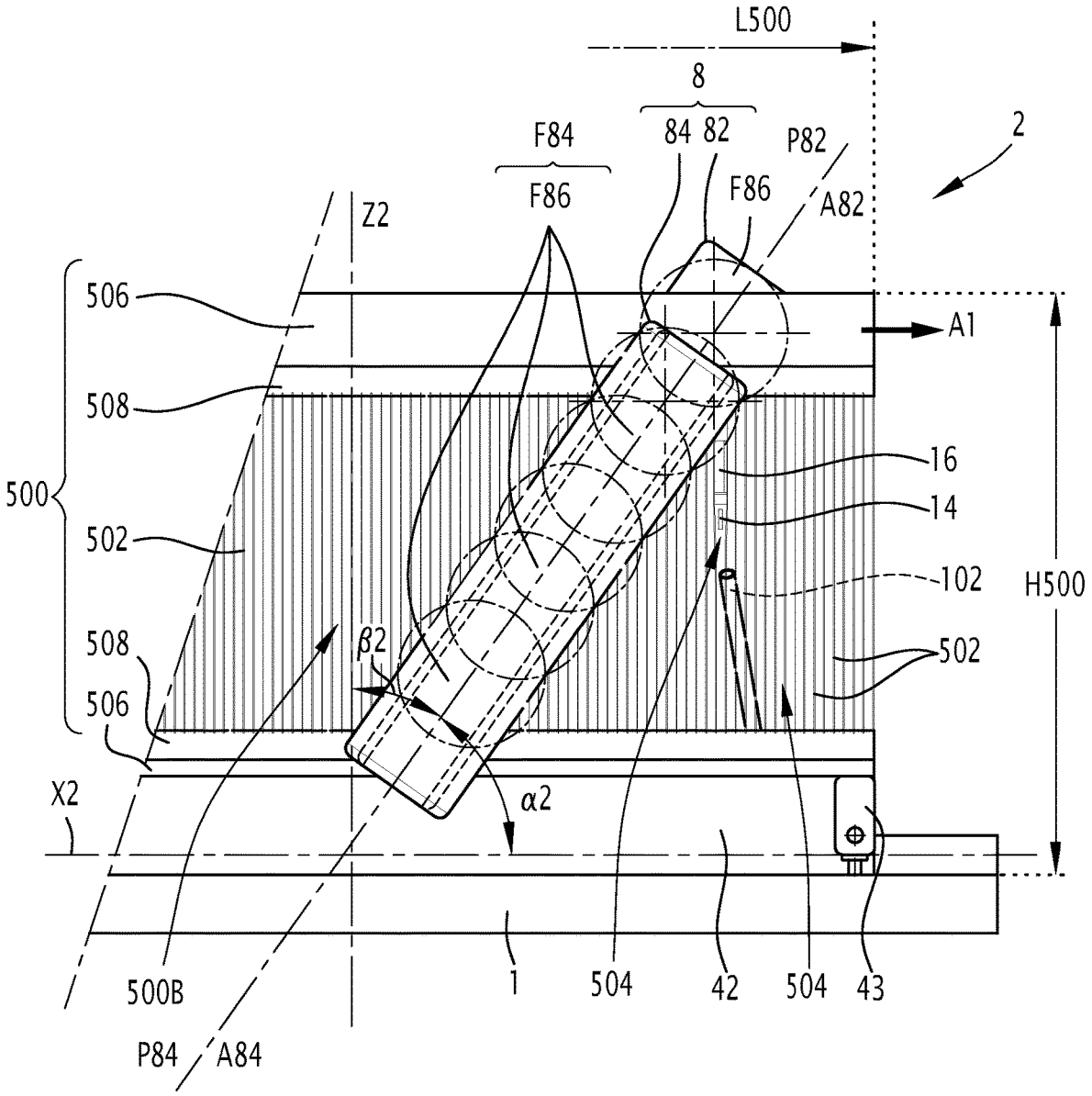
FIG. 4 is a side view of the reed monitoring assembly of FIG. 3.

In the second embodiment of the invention represented on FIGS. 3 and 4, elements similar to the ones of the first embodiment bear the same references and are not described in detail, unless necessary. Hereafter, one describes mainly the differences between the first and second embodiments.

The drawing-in machine associated with the reed monitoring assembly 2 of this embodiment includes a warp yarn layer 12 and a hook 14, for drawing one warp yarn 12A along a drawing-in channel represented by its axis Y14. A blade 16 is movable along the drawing-in channel Y14 between a retracted position out of a reed gap 504 and an inserted position within a reed gap 504, between two adjacent dents, as represented on FIGS. 3 and 4 in order to widen the reed gap 504 extending along the axis Y14 and which is supposed to be crossed by warp yarn 12A.

Arrow A1 represents the direction of movement of the reed carrier 42 and reed 500 with respect to the optical device 8 during the reed monitoring process to be implemented with the reed monitoring assembly 2.

In this second embodiment, the two camera arrays 82 and 84 are inclined with respect to the longitudinal direction L500 of the reed 500 and with respect to the height direction H500 of the reed 500. Longitudinal axes A82 and A84 of camera arrays 82 and 84 are defined as in the first embodiment. They are parallel to a plane including directions L500 and H500. In a plane including directions L500 and H500, I axes A82 and A84 each define an acute angle $\alpha 1$, respectively $\alpha 2$, with axis X2 and an acute angle $\beta 1$, respectively $\beta 2$, with an axis Z2 parallel to the height direction H500. Angles $\alpha 1$ and $\alpha 2$ are chosen between 15° and 75°, preferably between 30° and 60°, more preferably equal to 45°. Angles $\beta 1$ and $\beta 2$ are respectively complementary angles to angles $\alpha 1$ and $\alpha 2$, thus also chosen between 15° and 75°, preferably between 30° and 60°, more preferably equal to 45°. Preferably, the blade 16 in the inserted position is at least partially in the combined field of view F82, F84 of at least one of the two camera arrays 82 and 84.

In the example of FIGS. 3 and 4, angles $\alpha 1$ and $\alpha 2$ are identical and angles $\beta 1$ and $\beta 2$ are identical. Thus, the two camera arrays 82 and 84 face each other along the transverse direction and central planes P82 and P84 defined as in the first embodiment are superimposed. This is advantageous, in order for the two camera arrays 82 and 84 to check the same dents 502 and reed gaps 504 at the same time. However, this is not compulsory.

Weaving reed 500 bears an identification mark 505, in the form of a QR code printed on its upper profile 506 preferably on the first or last 10 centimeters along the reed length L500, and the sensor 86 of the first camera array 82 looking at the upper profile 506 is capable of reading this identification mark and forwarding the corresponding information to controller 6, within signal $S'_{86}$.

In the first two embodiments of the invention, the reed monitoring assembly 2 has a non-represented touch screen for inputting some information about the reed 500 to be monitored and the reed monitoring process to be implemented with this reed monitoring assembly 2. This information belongs to the inputs for the reed monitoring process to be implemented with reed monitoring assembly 2.

If a reed identification marking, like QR code 505 of the second embodiment, is provided, it can be used for automatically identifying the reed 500 to be monitored. This also belongs to the inputs for the reed monitoring device.

In addition, the operator for the monitoring process can input the following information:

reed settings, such as reed density;

monitoring speed, that is a choice between a case where the reed is carefully inspected, at low speed, and a case where the reed is basically inspected, at high speed;

customers threshold such as maximum acceptable reed wear and tear to be authorized for further use of the weaving reed 500, maximum acceptable depth of a scratch/groove on a dent 502 to be authorized for further use of the reed, etc. . . .

drawing-in pattern, in particular the number of warp yarns to be inserted per reed gap 504, the type of warp yarns, the dimensions of the drawing-in hook 14 and of the blade 16.

When starting the reed monitoring process, the operator can choose between two reed monitoring modes, namely:

In a first reed monitoring mode, the whole reed, i.e. the reed 500 along its whole length L500, is inspected, that is monitored, with reed assembly 2 prior to drawing-in the different yarns of yarn layer 12 in the reed gaps 504. In such a case, the start position of the reed for the reed monitoring process is advantageously opposite to the start position of the reed for the drawing-in process. Preferably, blade 16 is inoperative during the reed monitoring process. In other words, it is possible to monitor the reed 500 without inserting the reed blade 16 in each successive reed gap 504, which speeds up the monitoring process. This first mode is represented on FIGS. 1 and 2.

In the second reed monitoring mode, monitoring and drawing-in reed occur in parallel. The start position of the reed for the reed monitoring process is the same as the start position for the drawing-in process. In this case, the optical device 8 must be placed, relative to the drawing-in channel Y14, in particular hook 14 and blade 16, in such a way that the camera arrays 82 and 84 look at the dents 502 and the reed gaps 504 before they come at the level of the drawing-in channel, without interfering with the movements of the hook 14 and the blade 16 along and parallel to the drawing-in channel. This second mode is represented on FIGS. 3 and 4 where arrow A1 represents the direction of movement of the reed carrier 42 and reed 500 with respect to the optical device 8 during the reed monitoring process and angles $\alpha 1$, respectively $\alpha 2$, are chosen such that the camera arrays 82 and 84 essentially extends in a direction opposite to arrow A1 with regard to the drawing-in channel.

Upon starting of the reed monitoring process, and irrespective of the reed monitoring mode chosen, controller 6 controls that the reed 500 is correctly clamped and positioned on reed carrier 42. Signal $S_{45}$ provided by clamping sensors 45 and corresponding signals provided by reed position sensors are checked by controller 6.

If the reed clamping and positioning is correct, the reed 500 is placed, along longitudinal axis X2 in the start position for the reed monitoring process. The start position can be when an extreme dent is in the combined field of view F82 or F84.

When the process starts with the first reed monitoring mode, reed transport device 4 moves the reed 500 continuously, at a regular speed, with respect to optical device 8. In a variant, movement of the reed can occur stepwise.

When the process starts with the second reed monitoring mode, reed transport device 4 moves the reed 500 in a stepwise way, with respect to optical device 8.

As mentioned here-above, when the first reed monitoring mode has been selected, the direction of movement of the reed carrier 42 relative to optical device 8 during the monitoring process is opposite to the main movement of the reed carrier 42 relative to the same optical device 8 during the drawing-in process. This allows directly placing the reed 500 in the right start position for the drawing-in process or close to the start position for the drawing-in process, at the end of the reed monitoring process.

During the reed monitoring process, and irrespective of the selected reed monitoring mode, each camera array 82 and 84 respectively takes images representing at least a portion of the reed on the first longitudinal side 500A, respectively on the second longitudinal side 500B, on a width, measured parallel to length L500, corresponding to at least two adjacent dents 502, preferably three dents 502, and one reed gap 504 defined between these two dents, preferably two reed gaps 504 defined between these three dents, to the lower coil 508, to the upper coil 508, to a part of the lower profile 506 and to a part of the second profile 506. The first image(s) taken by the first camera array 82 are sent to the controller 6, in particular its memory 64. The second image(s) taken by the second camera array 84 are sent to the controller 6, in particular its memory 64. The reed is moved with respect to the optical device 8, along the axis X2.

If the weaving reed 500 is provided with an identification mark, as considered here-above with QR code 505, the top part of the reed, that is one side of the upper profile 506, is covered by the field of view F82 or F84 of one of the two camera arrays 82 and 84, in at least the first or last 10 centimeters of the movement of the reed with respect to the optical device 8. This enables taking an image of the QR code 505 with the optical device 8, such that controller 6 automatically identifies the reed 500.

If the second reed monitoring mode is selected, images of a set of reed dents 502 and corresponding reed gaps are taken when the blade 16 is in retracted position out of a reed gap 504 and some other images are taken when this blade is in inserted position within this reed gap 504.

In case the movement of the reed 500 with respect to the optical device 8 occurs stepwise, controller 6 controls camera arrays 82 and 84 so that image capture preferably occurs when reeds 500 and optical device 8 are not in relative movement. Between two movements of the reed 500 with respect to the optical device 8, only one of the camera array 82, 84 can take one or more images or both camera arrays can take one or more images. In case only one camera array take picture(s), sending of the image data to the controller 6 occurs for this camera array only.

Preferably, the two opposite camera arrays 82 and 84 are synchronized so as to take some images of the reed 500 at the same time.

In addition, illumination by the two illumination ramps 88 is synchronized with image capture. Since illumination can be obtained with either one of the two illumination ramps 88 or with these two ramps at the same time, illumination can be controlled depending on which camera array 82 and/or 84 takes an image of the reed 500, so as to obtain front light and/or back light for each image.

When images are taken, preferably, at least one illumination ramp 88 is actuated. More precisely, the first illumination ramp 88 mounted on the first camera array 82 is actuated to provide front light to the first longitudinal side 500A of weaving reed 500 facing this camera array. Since the second camera 84 array takes pictures at the same time as the first camera array 82 because of the synchronization, the light provided by the first illumination ramp 88 forms a back light for the images taken by the second camera array 84, on second longitudinal side 500B of weaving reed 500. The same applies, vice versa, for the second illumination ramp 88 mounted on the second camera array 84, which provides front light on the longitudinal side 502B of weaving reed 500 and back light on the opposite side 502A. Moreover, the two camera arrays 82 and 84 and the two illumination ramps 88 can be used at the same time, in which case both front light and back light are provided at the same time for the pictures of the two portions of the weaving reed.

The image capture frequency is adapted to the speed of the relative movement between the reed 500 and the optical device 8, in particular in case of continuous relative movement between parts 500 and 8. The image capture frequency is chosen so as to obtain at least one image of each dent 502 and of each reed gap 504 during the reed monitoring process.

When reed monitoring assembly 2 includes an airflow measuring device 10 as explained here above for the first two embodiments, controller 6 can control one or several air nozzles 102 turned towards a reed dent or several reed dents 502 which is/are in the combined field of view F82 or F84 of the camera array, in order to eject air on this/these reed dent(s). Images of the reed dent(s) 502, which are in contact with the ejected air, are taken before and/or during and/or after air blow with nozzles 102.

Controller 6 correlates each image data received from each optical sensor 86 with information provided by movement measuring sensor 43 or by signals S'46 from electric motor 46 concerning the relative position, speed and/or acceleration between the reed 500 and the optical device 8. Controller 6 also correlates each image data with the focus distance of the lens of the optical unit 90 associated with each optical sensor 86 at the time of the image capture. This controller 6 also correlates each image data incorporated within a signal $S'_{86}$ with the corresponding optical sensor 86 within the camera array 82 or 84.

If, as considered here-above in a variant, an optical unit 90 includes a lens with a fixed focus length, the focused distance is known by the controller. Otherwise, this focused distance is known from the voltage applied to the lens, within signal $S_{90}$, as explained here-above.

An anomaly detection occurs during the reed monitoring process if one of the clamping sensors 45 provides an information that the controller 6 analyzes as a release of a clamp 44 or if one the reed position sensors gives some information that the controller analyzes as a movement of the reed 500 relative to the reed carrier 42. If such an anomaly occurs, the reed monitoring process is stopped and a corresponding information is displayed on the non-represented screen of the reed monitoring assembly 2 or on the non-represented screen of the drawing-in machine. The operator is warned that he has to adjust the reed holding on the reed carrier 42 and, if necessary, to position again the reed carrier in the start position of the reed monitoring process and to overwrite previous image data. Then, the operator has to start again the reed monitoring process. In other words, the current reed monitoring of the weaving reed 500 is associated to image data taken when the weaving reed 500 moves relative to the optical device 8 only along axis X2, starts when the weaving reed 500 is in start position relative to the reed monitoring assembly 2 and ends when the weaving reed 500 is disassembled from the reed monitoring assembly 2, Image data processing occurs within controller 6 and/or within the main controller 666 of the drawing-in machine. The processor 62 and the memory 64 are used for image data processing and the processor is programmed to manage image overlap within a field of view F82 or F84, since overlap occurs as mentioned here-above in connection with shaded zones Z86. In case non-telecentric optics are used within an optical unit 90, the processor is programmed to apply a software correction to the images coming from the associated sensor 86, in order to rectify them.

The processor 62 used for image data processing also includes calculation means in order to provide a reed data, that is pre-processed data or processed data deduced from the image data received within the respective signal $S'_{86}$ and from the position/speed/acceleration information received from movement measuring sensor 43.

If the reed monitoring assembly 2 is provided with an airflow measuring device 10, the controller compares images of the same dent with or without an air blow, in order to detect loosen dents, if any.

The processor used for image data processing is also able to compare images of the same dent taken at different times.

The focus length of the lens of each optical unit 90 of the first and second camera arrays 82 and 84 provides a relationship between pixel size and the real dimensions on the weaving reed 500. This is used during computations made by the processor, in order to determine the real dimensions of the parts of the weaving reed 500.

Raw data obtained from sensors 86 and processed image data, including reed geometry data and reed position/speed/acceleration data, are stored in the memory 64 of the controller 6 and/or 666.

The reed data processed by the processor, that is the reed data provided by the reed monitoring assembly 2, can include local reed data like:

- the dimensions of a reed gap 504, in particular its thickness parallel to length L500
- the thickness of a reed dent 502, i.e. its dimension parallel to length L500
- an inclination angle between a reed dent 502 and a profile 506,
- an inclination angle between two adjacent dents 502,
- presence of loosen dents 502,
- absence of dents 502 that should theoretically be present, i.e. detection of a missing dent 502
- presence of a damage to a coil 508,
- the dimensions of the external geometry of side surface of a dent,
- dent roughness, curvature, sharpness and finishing on their lateral side surfaces,
- damage on a sealing compound, such as a resin, used for holding dents 502 within profiles 506 or coils 508,
- presence of rust on dents 502,
- presence of damage on a surface treatment or coating of a dent 502,
- presence of damage on an aluminum profile 506,
- presence of dent scratch, minor and major grooves on the dents, for instance made by the weft when using a positive rapier,
- presence of broken dents,
- presence of slightly bent dents,
- clinical properties of the dents, in particular when a surface treatment has been applied,
- dirt/wear level of the dents, which derives from the measured dent thickness and the normal value of the dent thickness,
- reed gap dirtiness, which corresponds to the presence of foreign material within the reed gap and which can be given in percentage of the reed gaps including such a foreign material.

The reed data processed by the processor can also include general reed data like:

- reed density, which can be variable along reed length L500,
- parallelism or angle between length extension of the two profiles 506,
- length L500 of the reed 500, Moreover, if the second reed monitoring mode is selected, the local reed data can include the distance between the blade 16 in inserted position and the closest coil 508, measured in a direction parallel to the height H500 of the reed 500.

For each image captured by an optical sensor 86, the local reed data includes:

- information on its location along the reed, that is along the direction L500 of the reed. Location is given by the number of the dent with regard to one extreme dent of the reed and/or by the distance between this dent and a longitudinal end of the reed. This can be expressed as: " . . . at 129.8 cm from the right end of the reed", and/or
- information on its location along the height H500 of the reed, which depends on the position of the optical sensor 86 within the camera array 82 or 84. For instance, this can be expressed as: " . . . at 12 mm from the top surface 503 of the upper profile 506.

The reed data can be displayed in real time on the screen of the reed monitoring assembly 2 or on the screen of the drawing-in machine. In addition, enlarged images taken by the first or/and second camera arrays 82 and 84 can be displayed on this screen, as raw data, or rectified images if one uses non-telecentric optics, in order to allow the operator checking the weaving reed 500 by eyes.

If some reed data exceed one or several threshold values given by the operator as limits in the inputs for the reed monitoring process, the reed movement along axis X2, in particular along arrow A1 for the second embodiment, is stopped and the image capture is stopped. An alarm is triggered, with audio signal and/or a message on the screen, and the reed monitoring assembly cannot continue performing the reed monitoring process without an acknowledgement of the alarm.

If some reed data exceed some threshold values provided as inputs, as explained here-above, or as soon as a loosen dent or a missing dent is identified and if reed monitoring assembly includes a non-represented marking device as considered here-above, the controller 6 sends a signal to the marking device for printing a mark on the reed, in particular on the upper profile. For instance, a red mark can be applied for a loosen or missing dent 502, a green mark can be applied for an irregularity on the dent, etc. . . . Preferably, the mark printed by the marking device is aligned, along the length L500 of the reed, with the dent 502 for which a threshold value has been exceeded.

Based on the reed data processed by the controller 6, the reed monitoring assembly 2 can also provide statistics and graphs to help the operator assessing the condition of the reed. For instance, the evolution of the wear of the dents 502 along the length L500 of the reed 500 can be represented as a function of the position of the dents along the longitudinal direction of the reed. Similarly, the percentage of dents with at least one irregularity can be represented graphically. The reed data of the current reed monitoring process can be correlated with reed data from a previous reed monitoring process associated to the reed ID to provide statistical information to the operator.

The reed data pre-processed or processed by controller 6 can also be outputted from this controller to a USB port or to a network connection, independent from connection line 6C, in order to be used by another equipment.

The reed data coming from the reed monitoring assembly 2 as a result of the reed monitoring process implemented with this assembly can be used for adjusting the drawing-in machine and the drawing-in process that will take place for the same reed just after the reed monitoring process in the following manner:

If one selects the first reed monitoring mode, depending on the reed data, in particular on the detected dimensions of the reed gaps 504, the controller 6 can recommend a specific blade 16 for use during the coming drawing-in process, at a later stage, among different blades whose features are stored in the memory of controller 6 and/or 666;

In case of stepwise relative movement between the weaving reed 500 and the optical device 8 during the drawing-in process, the drawing-in machine can adjust the step advance movement of the reed 500 to a value derived from the reed data. In particular, the step advance value can be non-constant along the length L500 of the reed and adapted locally to the expected position of the dents 502 coming in succession along the longitudinal direction of the reed 500;

The drawing-in machine can adjust the position of the reed carrier 42 relative to the drawing-in channel Y14, parallel to the height H500 of the reed. Actually, with the current drawing-in machines, the position of the reed carrier 42 is adjusted by hand once, along the height H500, before starting the drawing-in process: the operator lowers the reed carrier if the reed is too high, in order to keep the drawing-in channel in a correct position. The present invention allows moving vertically the reed carrier 42 with a dedicated electric motor which can be controlled by the controller 6, depending on the reed data, in order to place the drawing-in channel Y14 at the most optimized position through the height H500 of the reed for each reed gap 504. This can be adjusted along the length L500 of the reed, before starting the drawing-in process or during the drawing-in process;

If one selects the first reed monitoring mode, the drawing-in machine can adjust the start position of the reed 500 along the longitudinal axis X2 for the drawing-in process. In case of drawing-in with different yarns, with some of them being thin yarns and some of them being heavy yarns, and depending on the drawing-in pattern and on the reed data, the start position for the drawing-in process can be adjusted in order to avoid drawing-in of heavy yarns in the smallest reed gaps 504.

If one selects the first reed monitoring mode, depending on the drawing-in pattern, the reed monitoring assembly 2 can recommend one reed for the fabric to be woven, amongst a set of already monitored reeds. For instance, if fragile yarns are to be drawn-in through the reed gaps 504 and if too many scratches or grooves have been detected on the dents 502 of a given reed 500, this reed could damage the yarns. In such a case, the drawing-in machine suggests using another reed.

If one selects the first or second reed monitoring mode, the reed monitoring assembly 2 can recommend cleaning of the reed 500 before drawing-in, in case the first mode has been selected, or before weaving, in case the second mode has been selected.

Irrespective of these adjustment possibilities, if one selects the first reed monitoring mode, the end of the reed monitoring process occurs when the last image is captured for the last set of dents 502. The end of the reed monitoring process is reported to the operator with a summary of all main reed data. Then, the operator has to check the position of the first reed gap 504 for the next operation, that is for the drawing-in process. This first reed gap 504 is brought to the start position of the drawing-in process, which can be made automatically at the end of the reed monitoring process, via reed transport device 4. In practice, this is made by aligning the first reed gap 504 used for the drawing-in process with the drawing-in channel Y14. Once this has been done, the operator must acknowledge this before starting the drawing-in process.

With the two reed monitoring modes, when the drawing-in process is finished, the controller 6 increases by 1 the number of drawing-in processes for which the reed 500 has been used, in relation to the identification of the reed which has previously been obtained, either by reading QR code 505 or via an input made by the operator. This enhances predicting maintenance operations for the reed 500. This information can be stored in the memory of the controller 6 and/or 666 and/or sent to a network for storing in a central computer.

Figure 5:
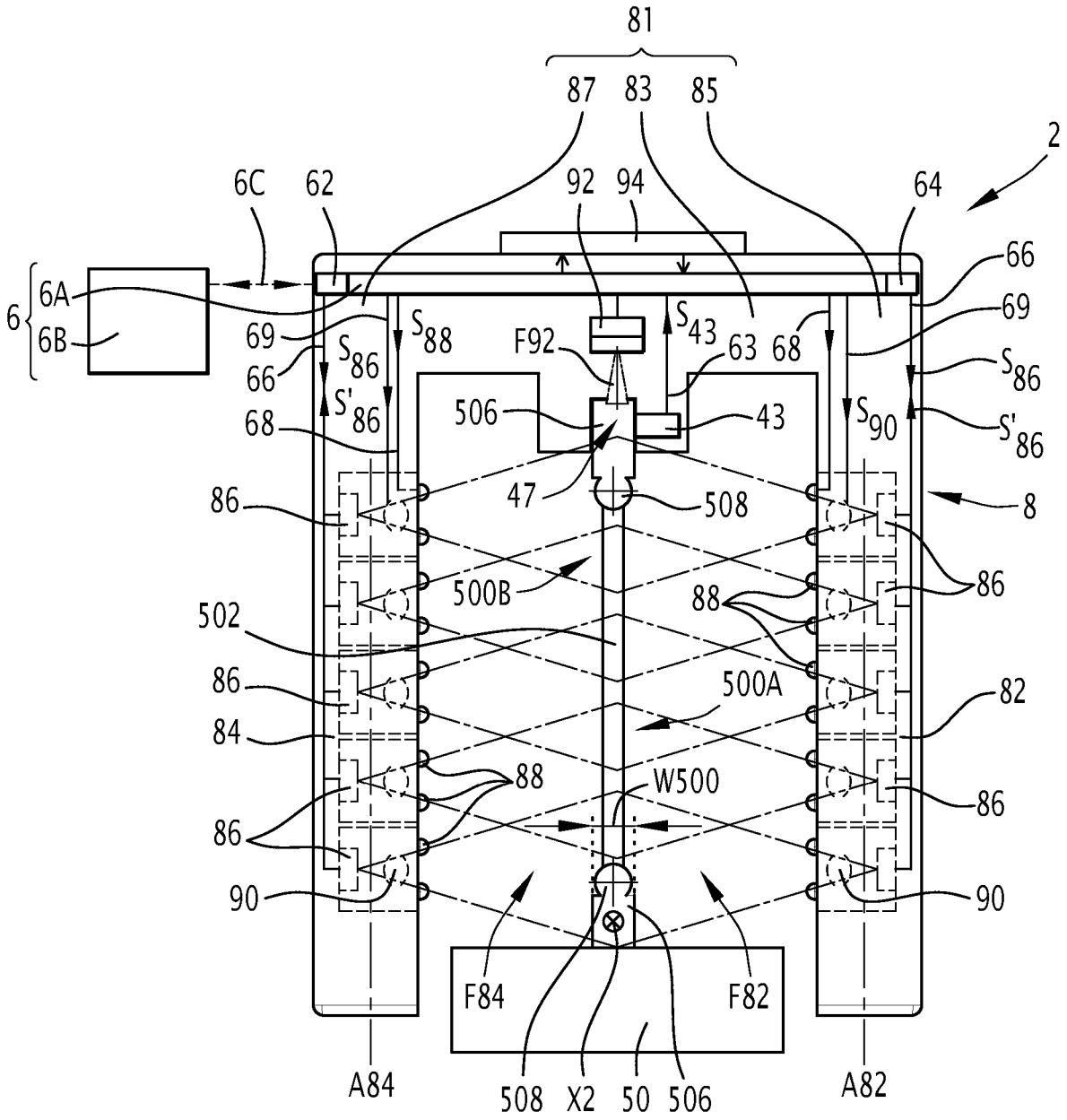
FIG. 5 is a front view of a reed monitoring assembly according to a third embodiment of the invention.
Figure 6:
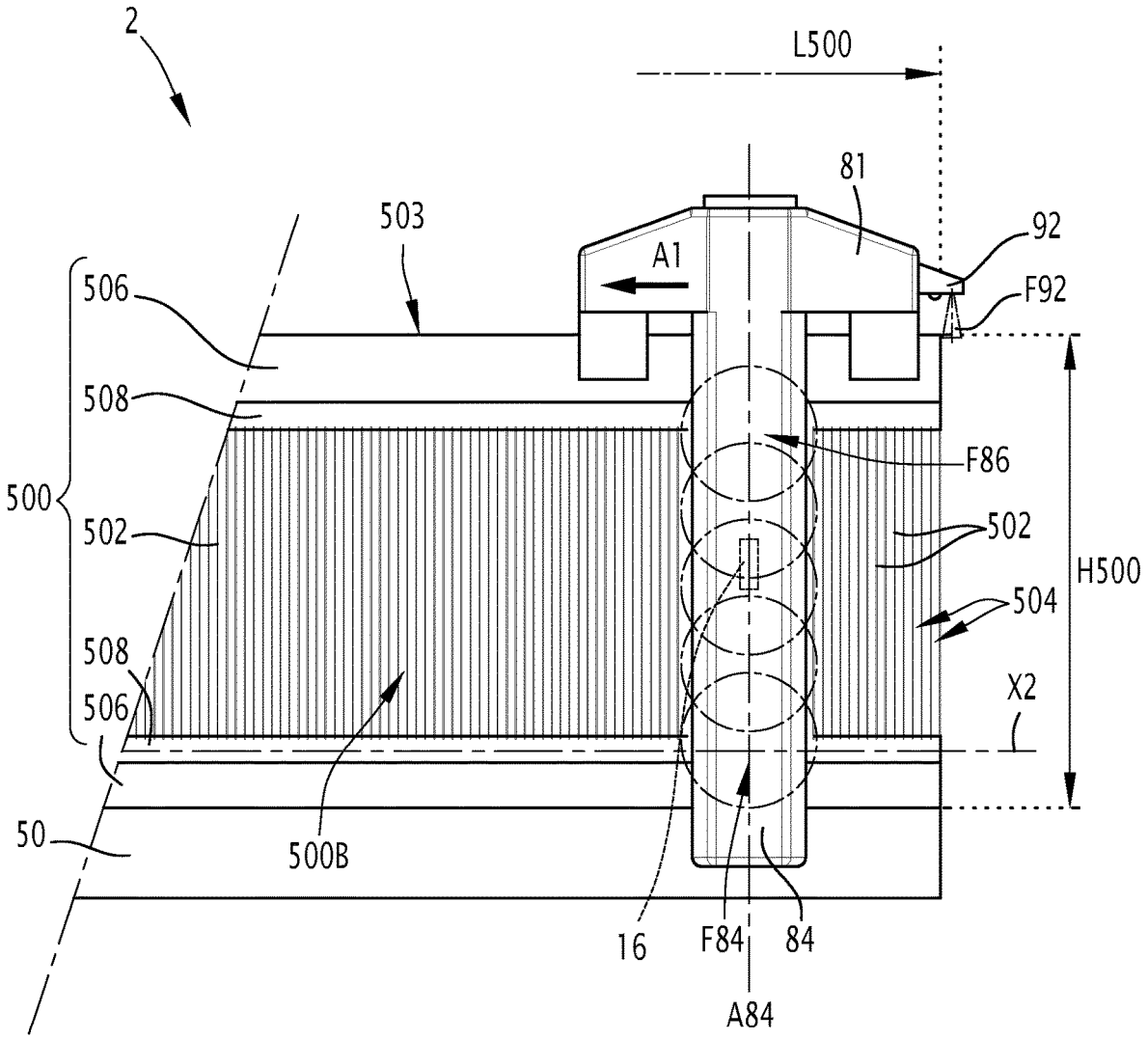
FIG. 6 is a side view of the reed monitoring assembly of FIG. 5.

In the third embodiment of the invention, represented on FIGS. 5 and 6, elements similar to ones of the first two embodiments have the same references and are not described in detail.

Here-after, mainly the differences with respect to the first embodiment are described. In this third embodiment, the reed includes straight dents 502 which do not form a tunnel similar to tunnel 502C of the first two embodiments. No airflow measuring device is provided.

The reed monitoring assembly 2 of this third embodiment is independent from a drawing-in machine and can be used with a weaving reed 500 mounted on a weaving loom, with a reed mounted on a drawing-in machine, with a reed mounted on a reed denting machine or with a reed mounted on a fixed reed holder 50, as represented on FIGS. 5 and 6.

The weaving reed 500 is preferably installed in a vertical position, with its height H500 vertical. Here, the reed 500 is static. In other words, it does not move relative to the space around during the reed monitoring process. On the other hand, the optical device 8 moves along the reed, as explained hereafter.

The optical device 8 includes a frame 81 formed of one cross-beam 83 and two legs 85 and 87 suspended to the cross-beam 83. The first camera array 82 includes a series of optical sensors 86 distributed within the first leg 85 while the second camera array 84 includes another set of optical sensors 86 distributed within the second leg 87. Unlike the first and second embodiments, the camera arrays 82 and 84 are here placed on a common frame 81. One illumination ramp 88 is fixed to each leg 85 and 87 and is respectively associated to the first camera array 82 and to the second camera array 84. Optical device frame 81, first and second camera arrays 82 and 84, including their optical sensors 86 and the associated optical units, and illumination ramps 88 together belong to optical device 8 that can be moved relative to the reed 500 along an axis X2 parallel to the length L500 of the reed 500.

In order to allow the movement of the frame 81 along the reed 500, this frame 81 comprises a reed housing 47 formed in the cross-beam 83. One of the profiles 506 of reed 500, preferably the upper one, is mounted in the reed housing 47, with possibility of movement relative to the optical device 8 along the longitudinal direction L500. Non-represented rollers projecting in the reed housing 47 and rolling on the profile 506 can facilitate the movement of the frame 81 along the reed 500.

The controller 6 of the reed monitoring assembly includes a first part 6A incorporated within frame 81, preferably at the level of crossbeam 83 and a static part 6B. These two parts communicate in both directions via a communication line 6C which is preferably wireless. In particular, raw image data or pre-processed image data can be continuously sent from the first mobile controller part 6A to the second static controller part 6B.

As in the first two embodiments, camera arrays 82 and 84 are distributed on both longitudinal sides of reed 500. The longitudinal axes A82 and A84 of camera arrays 82 and 84 are vertical, as in the first embodiment. In other words, longitudinal axes A82 and A84 are perpendicular to axis X2 and parallel to height direction H500. They can also be inclined with respect to axis X2, as in the second embodiment.

The displacement of the optical device 8 along axis X2 can be obtained by the operator pushing this device along reed 500. In such a case, the reed housing 47 or its rollers belong to the mounting means together with the frame 81, allowing the relative movement between the reed 500 and the optical device 8.

In a variant, an electric motor controlled by controller 6 can be used for displacing optical device 8 along axis X2, parallel to length L500.

A movement measuring sensor 43 mounted within crossbeam 83 provides, at all time, an information about the relative position, speed and/or acceleration between the reed 500 and the optical device 8. This sensor 43 is connected to the first part 6A of controller 6 by an electric line 63 conveying the output signal $S_{43}$ of movement measuring sensor 43.

In case displacement of optical device 8 along reed 500 is made manually by the operator, movement measuring sensor 43 enables checking that the relative speed between items 500 and 8, as imparted by the operator, is within an acceptable range, enabling a good reed monitoring, with a good image capture of all reed gaps 504 and all dents 502. If the speed sensed by movement measuring sensor 43 is not within a predetermined range, controller 6 triggers an audible and/or visible alarm. Arrow A1 represents the direction of movement of the optical device 8 with respect to the reed 500.

Signals $S_{86}$, $S'_{86}$, $S_{88}$ and $S_{90}$ are used as in the first embodiment.

On FIG. 6, each circle in chain dotted lines represents the field of view F86 of one optical sensor 86 and the combined areas of these circles represent the combined field of view F84 of the second camera array 84.

As the upper profile 506 serves as a guide for the sliding movement of the optical device 8, it is partly surrounded by crossbeam 83, so that it cannot be efficiently monitored by the respective combined fields of view F82 and F84 of the two camera arrays 82 and 84. In order to compensate for this, optical device 8 includes an additional camera array 92 provided with a non-represented optical sensor dedicated to take images of the top surface 503 of the upper profile 506 and possibly of its two lateral surfaces. This optical sensor can be of the same type as optical sensors 86 of the first and second camera arrays 82 and 84. It can also be of a different type. The camera array 92 is connected to first part 6A of controller 6.

If a reed marking similar to QR code 505 of the second embodiment is present on one of the lateral surfaces or on the top surface 503 of the upper profile 506, camera array 92 can be programmed for reading this marking. As visible on FIGS. 5 and 6, the field of view F92 of third camera array 92 is directed towards the top surface 503, and possibly towards the lateral surfaces, of the upper profile 506.

In order to increase the stability of optical device 8 mounted on reed 500, and according to a non-represented feature of the invention, two adjustable arms can extend from frame 81 in order to cooperate with the lateral surfaces of the lower profile 506 or with the reed holder 50. These arms can also be provided with rollers in order to facilitate the translation movement of the optical device 8 along the axis X2.

According to a non-represented variant of the invention, the reed monitoring assembly 2 of this embodiment can include an airflow measurement device, with one or several nozzle(s) and one sensor, similar to nozzle 102 and airflow sensor 104 of the first two embodiments.

The reed monitoring process implemented with the reed monitoring assembly 2 of the third embodiment is very comparable to the one of the first two embodiments, but for the fact that it is not the reed which is moved with respect to a fixed optical device, but it is the optical device 8 which is moved with respect to the reed 500 which remains stationary during this process.

At the end of the reed monitoring process, when the reed optical device 8 has been displaced along the whole length L500 of the reed 500, the reed data are available for the operator at the level of parts 6A and/or 6B of controller 6 and can be displayed on a screen 94 mounted on the upper surface of crossbeam 83.

According to an optional aspect of the third embodiment, and as represented on FIG. 6 only for the sake of simplicity, the reed monitoring assembly 2 can be associated to a blade 16 whose geometry and movements are similar to those of the blade 16 of the second embodiment. A motor controlled by the controller 6 drives the blade between an inserted position inserted in a reed gap 504 and a retraced position out of the reed gap. At least one image of the reed dents 502 and reed gaps 504 is taken when the blade 16 is in inserted position, on one side 500A and/or on the other side 500B of the reed 500. The dimension of the blade 16 along the longitudinal direction, that is parallel to the axis X2, is preferably larger than the longitudinal dimension of a reed gap 504 of the reed such that, in inserted position, the blade 16 spreads apart the two dents 502 of the reed gap in which it is inserted. Preferably at least one image of these two dents 502 is also taken, on one side 500A and/or on the other side 500B of the reed 500, when the blade is in retracted position.

This optional aspect of the invention may also be implemented with the first and second embodiments According to a non-represented alternative embodiment of the invention applicable to all embodiments, the first and second camera arrays 82 and 84 can be associated with a supplementary miniaturized optical sensor, in the form of a mini camera, which is designed and configured to be moved within a reed gap 504, in order to provide additional information with respect to the dimensions of this gap or to the surfaces of the adjacent dents 502. Such an additional miniaturized optical sensor can be mounted on the drawing-in hook 14 or on the blade 16 and may be associated with non-telecentric optics.

Irrespective of the embodiment considered, the reed data of the current reed monitoring process can be correlated with reed data of a previous reed monitoring process associated to the reed ID, in order to provide statistical information to the operator. In particular, for a given reed ID, the controller 6 of the reed monitoring assembly 2 can provide relative reed data depending on image data of the current reed monitoring process and on reference data associated to the reed ID. For example, relative reed data are obtained by comparison between image data or reed data of the current reed monitoring process and associated reference data, the data from the current reed monitoring process and the reference data corresponding to the same location along the reed. Reference data are for example stored in the memory 64 of the controller 6 of the reed monitoring assembly prior the start of the current reed monitoring process of the weaving reed. In all cases, reference data are data that are not derived from the image data of the current monitoring process. Reference data associated to the reed ID can be image data and/or reed data coming from another reed monitoring process associated to the reed ID, for example a previous reed monitoring process of the same reed. Reference data associated to the reed ID can also come from image data acquired during a reed monitoring process of a reed sample associated to the reed ID. The image data and/or reed data associated to the reed sample serve as reference data for all reeds ID that are associated to this sample reed. In alternative, reference data can be some of the inputs brought by the operator to the reed monitoring assembly 2 prior to the reed monitoring process and, in that case, these reference data do not come from any image data acquired during a reed monitoring process done with the reed monitoring assembly.

Irrespective of the embodiment considered, telecentric and/or non-telecentric optics can be combined with front light and/or back light, in order to get as much information as possible from the images collected by the first and second camera arrays 82 and 84.

In all embodiments, each camera array 82 or 84 can be formed by an association of several camera modules adjacent to one another along the longitudinal axis A82 or A84 of the camera array. This enables adjusting the longitudinal dimension of a camera array to the dimensions of the reed, in particular its height H500. In addition, each camera array can be formed by an association of several camera modules adjacent to one another along the longitudinal direction L500 of the reed. This enables adjusting the dimension of a camera array to the monitoring speed, that is the speed of the relative movement between reed 500 and optical sensor 8 to ensure at least one image of each dent and reed gap is taken. The association of several camera modules or optical sensors within a camera array allows the camera array to be scalable.

In all embodiments, combined fields of view F82 and F84 may overlap.

When the reed monitoring assembly 2 of the invention is used in conjunction with a drawing-in machine, as in the first two embodiments, the reed transport device 4 is not specific to the reed monitoring assembly. One can use a reed transport device which is part of the drawing-in machine and displacement of the reed 500 along axis X2 can be made in several steps. When the reed 500 is clamped on reed carrier 42 and when the blade 16 is inserted within a reed gap 504, the clamp or clamps 44 can be released and moved along the reed, before being clamped again, which allows a further displacement of the reed along axis X2 once blade 16 is in retracted position, withdrawn from reed gap 504.

In all embodiments, in case the movement of the reed 500 with respect to the optical device 8 occurs stepwise, the displacement of the reed 500 with respect to the optical device 8 between two movements of the reed 500 with respect to the optical device 8 is preferably calculated by summing up the reed gap thickness and the dent thickness of the weaving reed 500 taken along the axis X2. This reed gap thickness and dent thickness can come from the inputs, in particular from the reed settings, or from the image data taken by the optical device 8. It allows placing each reed gap at the same relative position along axis X2 with regard to the optical device 8.

According to a non-represented variant of the invention applicable to all embodiments, an illumination ramp 88 can be provided on one only of the two camera arrays 82 and 84. For instance, an illumination ramp 88 is mounted on first camera array 82 only. In such a case, it provides front light for sensors 86 of first camera array 82 and back light for sensors 86 of second camera array 84.

According to a non-represented variant of the invention especially applicable to the first and second embodiments, position and inclination of first camera array 82 and second camera array 84 along axis X2 can be adjustable such that the central planes P82 and P84 of the camera arrays are not aligned. In that case, the offset between these central planes can be one of the inputs for the reed monitoring process to be implemented with this configuration of the optical device 8.

Sighting axes Y86 of the first camera array 82 and of the second camera array 84 have been described parallel to the width direction W500. However, this is not compulsory and at least some sighting axes of the first camera array 82 and/or of the second camera array 84 may be inclined relative to a plane including longitudinal direction L500 and width direction W500 of the weaving reed while covering the first longitudinal side 500A, respectively the second opposite longitudinal side 500B.

First and second camera arrays 82, 84 have been described as made of several optical sensors 86 or camera modules. But according to a non-represented variant of the invention, first and/or second camera array can be formed by a single camera module provided that the camera module field of view covers, without discontinuities, a portion of a longitudinal side of the weaving reed, this portion being preferably elongated in the height direction of the weaving reed.

All described connecting lines can be wired or wireless connections.

The reed monitoring device can be used to monitor weaving reeds of all kinds, such as air jet, flat, double, fine or irregular reeds.

The embodiments and variants mentioned here-above can be combined in order to generate new embodiments of the invention.

The invention claimed is:

1. A reed monitoring assembly for monitoring a weaving reed, said weaving reed having a first longitudinal side, a second longitudinal side opposite to the first longitudinal side, a plurality of dents juxtaposed along a longitudinal direction of the weaving reed and two reed profiles surrounding two ends of the plurality of dents, the plurality of dents defining a height direction of the weaving reed and, between each pair of two adjacent dents of the plurality of dents, a reed gap, the weaving reed defining also a transverse direction perpendicular to the longitudinal direction and to the height direction, the reed monitoring assembly including an optical device with at least a first camera array for taking images of a first portion of the weaving reed, the first camera array facing the first longitudinal side of the weaving reed, a controller for controlling the optical device and for receiving image data from the optical device; and mounting means allowing a relative movement between the weaving reed and the optical device, along an axis parallel to the longitudinal direction of the weaving reed, wherein the optical device includes an illumination device for illuminating the first portion of the weaving reed and a second camera array, for taking images of a second portion of the weaving reed, the second camera array facing the second opposite longitudinal side of the weaving reed;

wherein each of the first portion and the second portion of the weaving reed includes at least a part of two dents of the plurality of dents and at least a part of each reed profile;

wherein each of the first and second camera arrays is formed of several optical sensors adjacent to one another; and wherein respective fields of view of two adjacent optical sensors of the several optical sensors overlap in the reed height direction.

2. The reed monitoring assembly according to claim 1, wherein the first and second camera arrays face each other, with the weaving reed in-between, along the transverse direction, and wherein the first and second camera arrays take images of identical dents of the plurality of dents and identical reed gaps of the weaving reed for a given relative position of the optical device with regard to the weaving reed along the axis of relative movement between the weaving reed and the optical device.

3. The reed monitoring assembly according to claim 1, wherein at least one of the first and second camera arrays includes non-telecentric optics.

4. The reed monitoring assembly according to claim 1, wherein at least one of the first and second camera arrays comprises an auto-focus lens controlled by the controller.

5. The reed monitoring assembly according to claim 1, wherein the mounting means include a reed drive generating the relative movement between the weaving reed and the optical device, along the longitudinal direction of the weaving reed, and wherein the controller controls the reed drive.

6. The reed monitoring assembly according to claim 1, wherein the reed monitoring assembly includes a nozzle for, in an operative state, blowing air on some dents of the plurality of dents, at a location aligned, along the longitudinal direction of the weaving reed, with a field of view of at least one of the first and second camera arrays.

7. The reed monitoring assembly according to claim 1, wherein the reed monitoring assembly includes an airflow measuring device including at least a nozzle for blowing air and one sensor for sensing an airflow, this sensor being connected to the controller.

8. The reed monitoring assembly according to claim 1, wherein the reed monitoring assembly includes a movement measuring sensor for sensing a relative position, a relative speed and/or a relative acceleration between the weaving reed and the optical device along the axis of relative movement between the weaving reed and the optical device, the movement measuring sensor being connected to the controller.

9. A drawing-in machine including at least a drawing-in unit for inserting, along a drawing-in channel, a warp yarn within a reed gap defined between two adjacent dents of a weaving reed, and a main controller, wherein the drawing-in machine includes a reed monitoring assembly according to claim 1 and wherein the optical device is fixed on a casing of the drawing-in unit.

10. The drawing-in machine according to claim 9, wherein the drawing-in unit includes a blade movable along the drawing-in channel, between a retracted position out of a reed gap and an inserted position, inserted between two adjacent dents of a weaving reed, wherein the two camera arrays are inclined with respect to the axis of relative movement between the weaving reed and the optical device and with respect to an axis parallel to the height direction of the weaving reed and wherein, when the blade is in its inserted position, the blade extends at least partially within a field of view of at least one of the first and second camera arrays.

11. A process for monitoring a weaving reed with a reed monitoring assembly, said weaving reed having a first longitudinal side, a second longitudinal side opposite to the first longitudinal side, a plurality of dents juxtaposed along a longitudinal direction of the weaving reed and two reed profiles surrounding two ends of the plurality of dents, the plurality of dents defining a height direction of the weaving reed and, between each pair of two adjacent dents of the plurality of dents, a reed gap, the weaving reed defining also a transverse direction perpendicular to the longitudinal direction and to the height direction, wherein said reed monitoring assembly comprises a controller and an optical device comprising a first camera array and a second camera array, each camera array being formed of several optical sensors adjacent to one another and the respective fields of view of two adjacent optical sensors overlapping in the reed height direction and wherein the process includes at least the following steps:

A) taking at least a first image of at least a part of each reed profile, a part of two dents of the plurality of dents and one reed gap in-between, on the first longitudinal side of the weaving reed, with the first camera array of the optical device of the reed monitoring assembly;

b) taking at least a second image of at least a part of each reed profile, a part of two dents of the plurality of dents and one reed gap in-between, on the second longitudinal side of the weaving reed, with the second camera array of the optical device of the reed monitoring assembly;

c) sending, to the controller of the reed monitoring assembly, image data corresponding to the first image;

d) sending, to the controller of the reed monitoring assembly, image data corresponding to the second image;

e) moving the weaving reed with respect to the optical device, along an axis parallel to the longitudinal direction of the weaving reed.

12. The process according to claim 11, wherein, during step e), the movement of the weaving reed along the axis parallel to the longitudinal direction of the weaving reed, with respect to the optical device, is continuous.

13. The process according to claim 11, wherein the process includes a further step of:

f) taking an image of a reed identification mark fixed on the weaving reed with the optical device of the reed monitoring assembly.

14. The process according to claim 11, wherein during steps a) and b), an illumination device is used as a front light for the first image and as a back light for the second image.

15. The process according to claim 11, wherein the reed monitoring assembly is associated to a blade which is movable between a retracted position out of the reed gap of the weaving reed and an inserted position, inserted between two adjacent dents of the plurality of dents of the weaving reed, and wherein, during step a) and/or step b), the first camera array, respectively the second camera array, takes at least an image when the blade is in the inserted position.

16. The process according to claim 11, wherein the reed monitoring assembly includes a nozzle for, in an operative state, blowing air on some of the dents of the plurality of dents, at a location aligned, along the longitudinal direction of the weaving reed, with a field of view of at least one of the first camera array and the second camera array wherein, during step a) and/or step b), the first camera array, respectively the second camera array, takes at least an image when the nozzle is in operative state and at least another image when the nozzle is not in operative state and wherein the controller compares these two images.

17. The process according to claim 11, wherein the process includes a step of providing information about at least one of the following parameters: dent thickness or reed gap thickness along the axis parallel to the longitudinal direction of the weaving reed, presence of broken dents or of loosen dents, presence of damages on the reed components and dirtiness of the reed components.

18. The process according to claim 11, wherein the process includes a step of providing relative reed data, depending on the image data of step c) or d) and on reference data, the reference data being associated to the weaving reed being pictured during steps a) and b) of the process and stored in a memory of the controller of the reed monitoring assembly prior to the process.

19. The reed monitoring assembly according to claim 1, wherein the first and/or the second camera array covers at least a full height of the plurality of dents.

20. The drawing-in machine according to claim 9 wherein the main controller of the drawing-in machine receives some image data from the optical device or some pre-processed data from the controller of the reed monitoring assembly.

* * * * *